United States Patent [19]

Mas

[11] 4,381,600

[45] May 3, 1983

[54] MAGNETIC CORE WINDING APPARATUS

[75] Inventor: Joseph A. Mas, Woodbury, N.Y.

[73] Assignee: Allied Corporation, Morris Township, Morris County, N.J.

[21] Appl. No.: 237,048

[22] Filed: Feb. 23, 1981

Related U.S. Application Data

[63] Continuation of Ser. No. 966,167, Dec. 4, 1978, abandoned.

[51] Int. Cl.[3] ..... H01F 41/02

[52] U.S. Cl. ..... 29/738; 29/605; 29/606; 29/609; 242/4 R

[58] Field of Search ..... 29/605, 606, 609, 738, 29/761; 242/4 R, 4 C

[56] References Cited

U.S. PATENT DOCUMENTS 1,857,215 5/1932 Ruder ..... 29/605
2,282,854 5/1942 Driftmeyer ..... 29/605 X
3,289,279 12/1966 Camp ..... 29/605
3,566,462 3/1971 Moore ..... 29/605

FOREIGN PATENT DOCUMENTS 2354279 1/1978 France .

*Primary Examiner*—Carl E. Hall
*Attorney, Agent, or Firm*—Gerhard H. Fuchs; Ernest D. Buff

[57] ABSTRACT

A method for forming a magnetic core around a prewound wire coil involves: passing an end of a strip of magnetically permeable metal through the center of the coil and forming it into a loop encircling the wire coil through its center; revolving the loop to wind the strip onto the loop until it has the desired thickness of the magnetic core to be formed; retracting the strip from the coil to reduce its circumference and to draw it tightly around the coil to form the magnetic core; followed by severing the core from the retracted strip. Apparatus for the practice of the method is provided.

4 Claims, 5 Drawing Figures

MAGNETIC CORE WINDING APPARATUS

This is a continuation, of application Ser. No. 966,167, filed Dec. 4, 1978, now abandoned.

BACKGROUND OF THE INVENTION

The present invention relates to the manufacture of electromagnetic induction devices, such as transformers, transducers and the like and, more particularly, to the manufacture of toroidally wound magnetic cores for such devices.

It is generally known that electromagnetic induction devices, such as transformers, having a toroidally wound core tightly encircling one or more wire coils of the apparatus have high efficiency, because they require less exciting current to establish a given flux as compared to cores constructed by other methods, such as E-I laminations or gapped wound cores. Such devices employing toroidally wound cores have not found wide use because of difficulties in their manufacture.

It is an object of the present invention to provide a method and apparatus for making toroidally wound magnetic cores for electromagnetic induction devices, wherein the core is formed around a pre-wound wire coil. Because of its simplicity and efficiency, this method is suitable for large-scale manufacturing operations.

SUMMARY OF THE INVENTION

The present invention relates to fabrication of electromagnetic induction devices having at least one magnetic core and at least one wire coil, and involves forming a toroidally wound magnetic core around at least one prewound wire coil.

The magnetic core is formed from a strip of magnetically permeable metal. A terminal portion of this strip is passed through the center (window) of the prewound wire coil, and it is formed into a loop encircling the wire coil through its center. The loop may be formed, for example, by attaching the terminal portion of the strip to the strip ahead of the coil, as by means of adhesives or adhesive tape, or spot welding. Next, the loop is revolved to wind the strip onto the loop to form a loop coil having the thickness of the desired final core. When the loop coil has reached that thickness, strip is retracted from the loop coil while preventing retraction of the end of the strip at the terminal portion in the center of the loop, to thereby reduce the circumference of the loop and to draw it tightly around the prewound wire coil to form the magnetic core. Thereafter, the strip is severed from the core and the free end of the strip on the outside of the core is attached to the core, as by spot welding, by use of adhesives or adhesive tape, or by means of a sleeve, to prevent unraveling of the core.

Toroidally wound cores made by this method tightly encircle the wire coil and thus provide for the shortest possible magnetic length. Further, since the core is wound from a continuous strip, there are no air gaps in the magnetic circuit. Consequently, maximum magnetic flux can be carried through the coil with minimum magnetic length and minimum exciting current.

The strip which is formed into the toroidally wound core in accordance with my invention is composed of magnetically soft material. Such materials desirably have the following combination of properties: (a) low hysteresis loss resulting from internal friction during the magnetic cycle; (b) low eddy current loss from electric currents induced by changes in flux; (c) low coercive force; (d) high magnetic permeability; (e) high saturation value; and (f) minimum or definite change in permeability with temperature, in special applications. Conventionally employed magnetically soft materials in strip form, such as high-purity iron, silicon steels, iron/-nickel alloys, iron/cobalt alloys and the like, are all suitable for use in the practice of the present invention. Particularly suitable, however, are strips of amorphous (glassy) magnetic alloys which have recently become available. Such alloys are at least about 50% amorphous, as determined by x-ray diffraction. Such alloys include those having the formula $$(Fe, Co, Ni)_{70-90}T_{0-15}X_{10-25}$$

which include one or more of the elements of iron, cobalt and nickel, wherein T is at least one of the transition metal elements, and X is at least one of the metalloid elements of phosphorus, boron and carbon. Part of the carbon, phosphorus and/or boron in X may be replaced by aluminum, antimony, beryllium, germanium, indium, silicon and tin. Used as cores of magnetic devices, such amorphous metal alloys evidence generally superior properties as compared to the conventional polycrystalline metal alloys commonly utilized. Preferably, strips of such amorphous alloys are at least about 80% amorphous, more preferably yet, at least about 95% amorphous. If desired, the strip may be provided with an insulating coating, as is conventional, to reduce eddy current losses.

Apparatus for the practice of the present invention for winding a magnetic core of strip of magnetically permeable metal around a prewound wire coil includes: a base; holding means for holding the prewound wire coil; driven winding means for winding the metal strip into a loop encircling the coil through its center (window); retracting means for withdrawing strip from the formed loop to reduce its circumference to that of the desired core; and means for engaging the end of the strip within the loop during the retracting operation to prevent unwinding of the loop.

The base supplies support for the holding means, the driven winding means and the retracting means.

The holding means holds the prewound wire coil in place during the loop-winding and strip-retracting operations. The holding means provides for proper positioning of the coil relative to the winding means, so that the loop of strip may be revolved around itself through the window in the coil to wind strip onto the loop.

The driven winding means engages the loop of strip of the magnetically permeable metal as it encircles the prewound wire coil through its window, as the coil is being held by the holding means. The driven winding means is adapted for revolving the loop around its axis normal to the plane in which the loop lies, and it is further adapted to be disengaged and withdrawn from the loop on completion of the winding operation.

The retracting means is adapted to withdraw strip from the outside of the formed loop without unwinding the loop to reduce the circumference of the loop until it tightly encircles the wire coil.

The means for engaging the end of the strip within the loop has the purpose of preventing retraction of the end of the strip within the loop, to effect tightening of the loop around the wire coil as strip is retracted from the outside of the loop. Unless that end of the strip were held in place, the loop would merely unwind as the strip is retracted.

BRIEF DESCRIPTION OF THE DRAWINGS

The present invention is more particularly described with reference to the annexed drawings, which form part of the present specification. It will be apparent, however, that these drawings illustrate only certain typical embodiments of the invention and should therefore not be considered as limiting the scope of the invention.

DETAILED DESCRIPTION OF THE INVENTION

Figure 1:
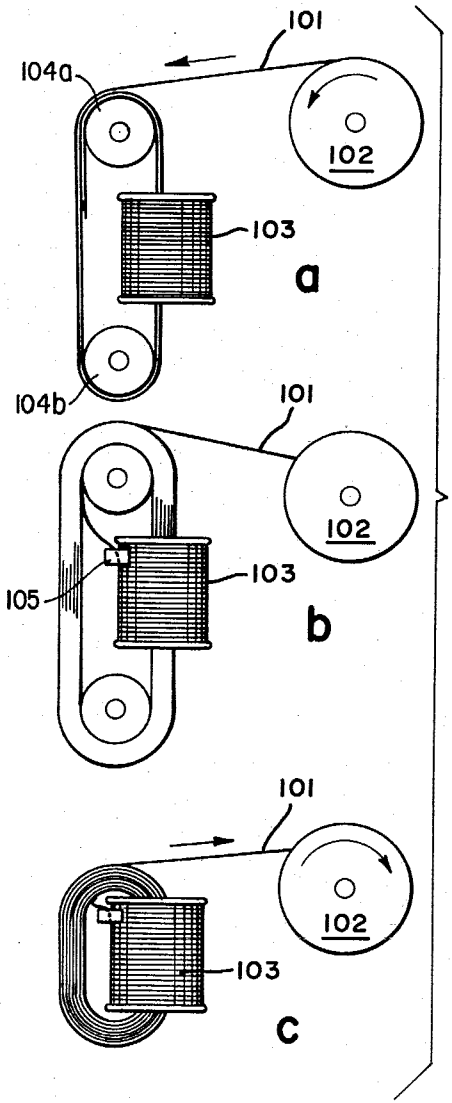
FIG. 1 is a schematic diagram illustrating one embodiment of the method of the invention involving winding of a toroidal magnetic core around a prewound wire coil.

My method of forming a toroidally wound magnetic core around a prewound wire coil is explained in more detail with reference to FIG. 1 of the drawings. The core is wound from a strip of magnetically permeable metal 101 which, as is illustrated, is supplied from storage reel 102. Prewound wire coil 103 has a center opening (window), through which the terminal portion of strip 101 is passed. Strip 101 is then formed into a loop encircling wire coil 103 through its center as shown in (a) of FIG. 1. This may be accomplished by affixing the terminal end of strip 101 to the underside of the strip, as by means of adhesive, adhesive tape or spot welding, in the manner indicated in (a) of FIG. 1. Thereafter, strip 101 is wound onto the loop by rotating (revolving) the loop around its axis normal to the plane in which the loop lies, until a wound loop coil (strip coil) having the thickness desired of the magnetic core to be formed is obtained. Of course, the diameter of the wound loop coil is in excess of the diameter of the desired core, and the wound loop coil thus formed does not yet tightly encircle the wire coil. Revolution of the loop, as above described, may be accomplished in any suitable manner, as, for example, by running the loop over a pair of co-directionally rotating rollers 104*a* and 104*b*, as shown in (a) of FIG. 1. Next, the terminal portion of strip 101 in the center of the loop is removed from the loop, and is secured to prevent its retraction as strip is withdrawn from the loop in the next following operation. The terminal portion may be secured in any suitable manner, as, for example, by affixing it to the outside of wire coil 103, as by use of adhesives or of a strip of adhesive tape 105, as illustrated in (b) of FIG. 1. Next, excess strip 101 is retracted from the loop coil, under prevention of retraction of the end of the strip at the terminal portion, which, as illustrated, is affixed to the wire coil 103, to thereby reduce the circumference of the loop coil and to draw it tightly around the wire coil, as illustrated in (c) of FIG. 1, to form the magnetic core. In that retraction operation, the thickness of the loop coil and of the final core remain unchanged, only the diameter of the loop coil is reduced until it tightly encircles the wire coil. Next, the free end of the strip is severed from the formed core, and the end of the strip of the coil is affixed to the coil, as by spotwelding or by means of adhesives, or by providing an enclosing sleeve, or by any other suitable means, to prevent unraveling of the formed core.

Figure 2:
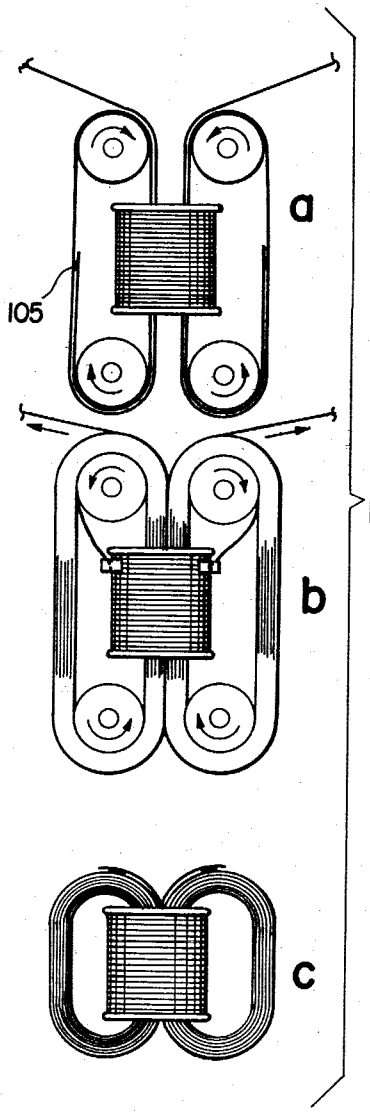
FIG. 2 is a schematic diagram illustrating winding of two toroidal magnetic cores around one prewound wire coil.
Figure 3:
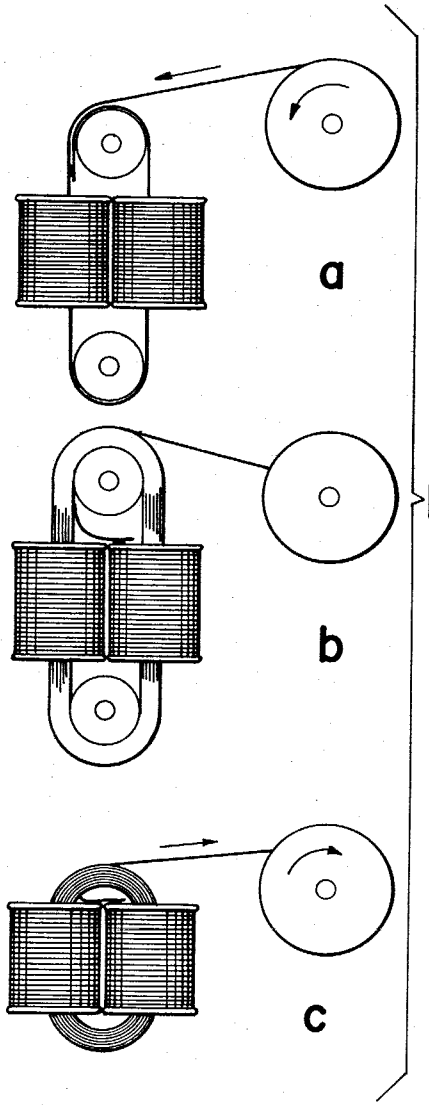
FIG. 3 is a schematic diagram illustrating winding of one toroidal magnetic core around two prewound wire coils.

If desired, two cores may be simultaneously formed around a single pre-formed wire coil, as illustrated in FIG. 2; or one or more cores may be simultaneously formed around one or more coils, as illustrated in FIG. 3, which shows formation of a core around two coils, all in the manner illustrated and described in connection with FIG. 1.

The method of my invention may be practiced by hand, or by use of suitable apparatus; it may be very expediously practiced by means of the apparatus described herein below.

Typical apparatus of the present invention is described in detail with reference to FIGS. 4 and 5. The apparatus includes the following major components: a base; holding means for holding the prewound wire coil; driven winding means for engaging a loop of strip of magnetically permeable metal which encircles the prewound wire coils through its center as the wire coil is being held by said holding means, and for revolving the loop around its axis normal to the plane in which the loop lies, and adapted to be disengaged and withdrawn from the loop; retracting means for withdrawing strip from the formed loop to reduce the circumference of the loop; and means for engaging the end of the strip within the loop and to hold it to prevent retraction thereof while the strip is being retracted from the loop.

The base comprises a base plate 1, whereon there is mounted support plate 2. Support plate 2 is provided with a center cut-out 3, and with an elongated adjustment slot 4. The base provides the means for holding and supporting the holding means, driven-winding means and retracting means.

Figure 4:
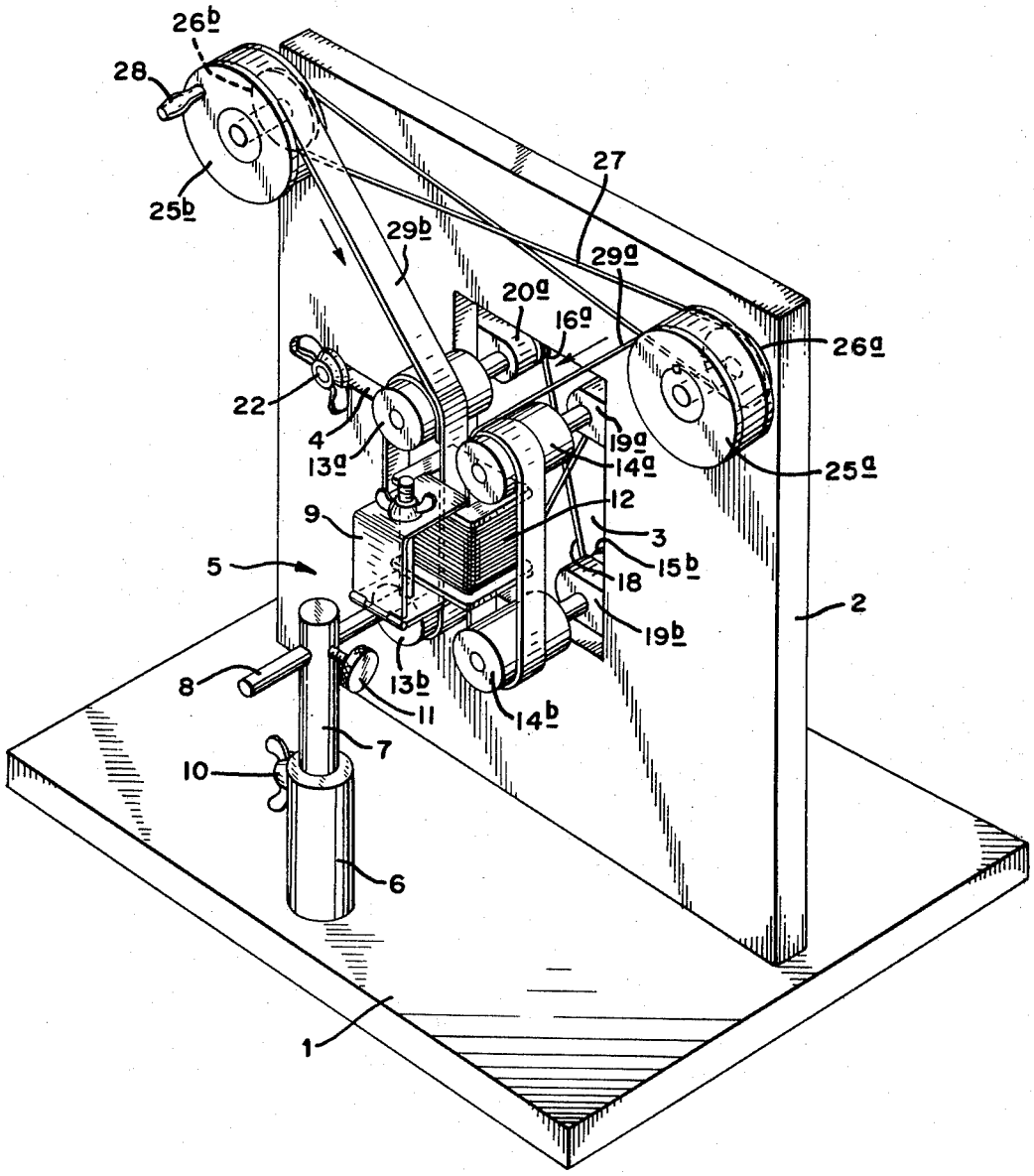
FIG. 4 is an isometric view of the front of apparatus for practice of the present invention.

The holding means for holding the prewound wire coil is located on the front side of the apparatus and is generally indicated by reference numeral 5 on FIG. 4. Holding means 5 is composed of a base tube 6; telescoping vertically extendable support rod 7; horizontally extendable support rod 8; and clamp 9. Base tube 6 is fixedly mounted on base plate 1. The lower portion of telescoping vertically extendable support rod 7 extends into and slidably engages base tube 6, wherein it may be held in fixed, predetermined position by means of lock nut 10. At its upper end, support rod 7 is provided with an aperture through which is passed the rear portion of horizontally extendable support rod 8 for support and sliding horizontal adjustment. Support rod 8 may be locked in predetermined position by means of lock nut 11. The front portion of support rod 8 carries clamp 9 for holding prewound wire coil 12. Holding means 5, by virtue of the above-described adjustable features, is adapted to hold different wire coils 12 of varying dimensions in proper relationship with respect to the below-described winding and retracting means, so that the apparatus can be used for winding strip coils around differently dimensioned wire coils. The adjustable features could be omitted if the apparatus were to be used for identically-sized wire coils only.

Figure 5:
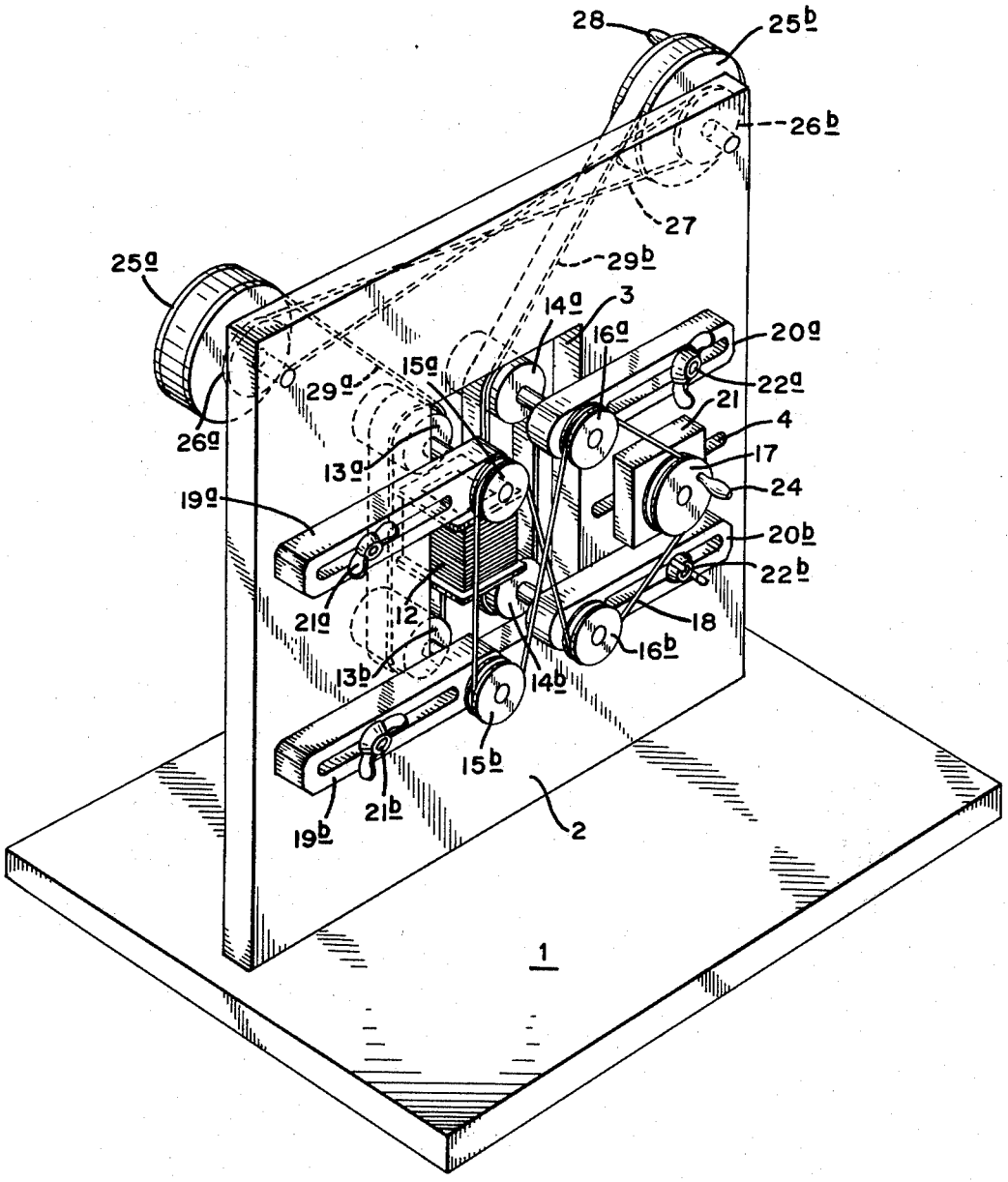
FIG. 5 is an isometric view of the rear of the apparatus illustrated in FIG. 4.

With respect to the winding means, FIGS. 4 and 5 illustrate apparatus employing duplicate winding means for simultaneously winding two magnetic cores around one wire coil. If only one core were to be wound at a time, that duplication could be avoided. The winding means generally includes the following major components: two pairs of driven winding rollers 13*a*, 13*b*, 14*a* and 14*b*, each associated with driven pulleys, 15*a*, 15*b*, 16*a*, and 16*b*, respectively, drive-pulley 17; and belt 18. The winding rollers and driven pulleys are mounted on opposite ends of a shaft, each roller being associated with one pulley, e.g., roller 13*a* with pulley 15*a*, roller 14*a* with pulley 16*a*, and so forth. The shafts connecting the rollers and pulleys extend through cutout 3 of support plate 2, and are rotatably journaled on slotted, adjustable winding roller supports 19*a*, 19*b*, 20*a*, 20*b*. These roller supports 19*a*, 19*b*, 20*a*, and 20*b* are attached to the backside of support plate 2 by means of bolts and wingnuts 21*a*, 21*b*, 22*a* and 22*b*, the bolts in each instance being affixed to the back of support plate 2 in symmetrical, paired, spaced-apart relationship on opposite sides of cutout 3. The bolts extend through the slots of the roller supports, and these supports are held in place in adjustable position by means of the associated wingnuts. The arrangement of the winding roller-pulley assemblies is such that the winding rollers 13*a*, 13*b*, 14*a* and 14*b* are located on the front side of support plate 2, and their associated pulleys 15*a*, 15*b*, 16*a* and 16*c* are located on the back side of support plate 2, with the shafts connecting rollers and pulleys extending through cutout 3. The winding rollers are further arranged such that the tangents along the inner side of each pair of rollers passes through the center (window) of prewound wire coil 12 near the perimeter of the center, on opposite sides thereof. The rollers are of such diameter that the tangent along the outer side of each pair of rollers clears the outer perimeter of prewound wire coil 12.

The above-described particular mounting arrangement for the winding rollers permits removal of the winding rollers from the apparatus by the simple expedient of removing the wingnuts and removing the roller-pulley support plate assemblies, as it is required at one point in the operation of the apparatus, as to be described, infra. The driven winding means further includes a drive pulley 17 which is rotatably mounted on mounting plate 21, which in turn, is mounted on the back side of support plate 2 by means of a locknut and bolt 22 extending through adjustment slot 4 on support plate 2. By this arrangement it is possible to move drive pulley 21 back and forth horizontally for the purpose of tightening belt 18. Belt 18 runs over the top of drive pulley 17, then over the top of driven pulley 16*a*, from there over driven pulley 15*b* from the side turned towards pulley 16*a* and around the outside (in the direction away from coil 12) of pulley 15*a*, over pulley 15*a* from the outside, then over pulley 16*b* from the inside and from there back to drive pulley 17. Drive pulley 17 is provided with eccentrically located handle 14. Rotation of drive pulley 17 by means of handle 24 will cause belt 18 to turn pairs of pulleys 16*a* and 16*b*, and 15*a* and 15*b*, (and pairs of associated winding rollers 14*a* and 14*b*, and 13*a* and 13*b*, respectively) each co-directionally within each pair, and in opposite direction from pair to pair.

The retracting means includes as its major components a pair of storage reels 25*a* and 25*b* rotatably mounted on the front side of support plate 2 in the upper portion thereof above the upper winding rollers 15*a* and 16*a*, and near opposite edges of support plate 2. Storage reels 25*a* and 25*b* are adapted to hold the strip of magnetically permeable metal which is to be formed into the strip coil around prewound wire coil 12, to feed the strip in the winding operation, and to retract it in the retracting mode. To the latter end, storage reels 25*a* and 25*b* are associated with coaxially mounted pulleys 26*a* and 26*b*. Belt 27 is run over pulleys 26*a* and 26*b* in cross fashion, so that, if either storage reel is turned, as by actuating storage reel 25*b* by means of handle 28, the other storage reel will turn in opposite direction.

In operation of the above described apparatus, storage reels 25*a* and 25*b* are wound with strip of magnetically permeable metal of lengths sufficient to form the desired wound magnetic core, plus that additional lengths of strip required to form the larger wound strip loop, as to be described below. The prewound wire coil 12 is mounted in clamp 9, and its location is centered between the winding rollers by means of the horizontal and vertical adjustments provided, as above described. Also, the spacing of the winding rollers is adjusted, if required, so that the tangents to pairs of rollers 15*a* and 15*b*, and 16*a* and 16*b*, pass through the window in coil 12 at its perimeter at opposite sides. Next, metal strip 29*a* is pulled from storage reel 25*a*, its free and is passed over the top of winding roller 16*a*, through the window of wire coil 12, to be looped over winding roller 16*b* and back to the vicinity of winding roller 16*a*, where it is brought underneath the strip 29*a*. The free end of the strip is then affixed to the strip, as by means of an adhesive or a piece of pressure sensitive adhesive tape, to form a loop through the window of coil 12, and over winding rollers 16*a* and 16*b*. Next, if coil 12 is to be provided with two wound magnetic coils, the operation is repeated with strip 29*b* from storage reel 25*b* to form a closed metal strip loop through the window of coil 12 and over winding rollers 15*a* and 15*b*. Then, if necessary, the spacing of the winding rollers is adjusted to tighten the strip loops, to provide for sufficient frictional engagement between the loops and the winding rollers to permit winding of additional strip onto the loops when the winding rollers are turned. Thereafter, the position of drive pulley mounting plate 21 is adjusted to tighten belt 18, as necessary, and by turning drive pulley 17 metal strip from storage reels 25*a* and 25*b*, is wound onto both strip loops running over the pairs of winding rollers 15*a* and 15*b*, and 16*a* and 16*b*, until the loops have the thickness of the desired cores. The combined thickness of the loops thus formed may correspond to the width of the window in wire coil 12. Once that thickness has been reached, or earlier, if thinner cores are desired, the free ends of the metal strip inside the loops are freed from the strip, and they are now affixed to the exterior of wire coil 12, as by means of adhesive tape, to hold these free ends in place as strip is withdrawn from the loops. Thereafter, winding reels 15*a* and 15*b*, 16*a* and 16*b* are withdrawn from the loop, as by removing these rollers together with the corresponding winding roller supports 19*a*, 19*b*, 20*a* and 20*b*, and components associated therewith, and metal strip is rewound onto storage reels 25*a* and 25*b* to reduce the circumference of the strip loops, without reducing their thickness, and to draw them tightly around prewound wire coil 12 to form the magnetic cores. The retracted strip is then severed from the formed coils, and the free ends of the strip at the core are affixed to the core, as by spot welding or by means of adhesives, and the completed assembly, that is the prewound wire coil with the toroidally wound magnetic strip core, or cores, as the case may be, is released from the clamp and removed from the apparatus.

Various changes and modifications may be made in carrying out the method of my present invention, and in the apparatus of my invention and its operation, without departing from the spirit and scope of my invention. Insofar as these changes and modifications are within the purview of the annexed claims, they are to be considered as part of my invention.

I claim:

1. An apparatus for winding a magnetic core from a strip of magnetically permeable metal around a prewound wire coil, comprising, in combination:

(a) a base;

(b) holding means mounted on said base for holding the prewound wire coil;

(c) driven winding means mounted on said base for engaging a loop of said strip of magnetically permeable metal which encircles the prewound wire coil through its center as the coil is being held by said holding means, and for revolving said loop around its axis normal to the plane in which the loop lies to form a wound core, with associated means for disengaging and withdrawing said winding means from said core; and (d) retracting means associated with said base for withdrawing said strip from the formed wound core to reduce the circumference of the core while the core is held by the holding means and the winding means is disengaged and withdrawn from the wound core.

2. The apparatus of claim 1 wherein the driven winding means comprise a pair of spaced apart driven winding rollers over which the strip of magnetically permeable metal is looped.

3. The apparatus of claim 1 employing duplicate driven winding means and retracting means adapted for simultaneously winding a pair of magnetic cores around at least one prewound wire coil.

4. The apparatus of claim 3 wherein the duplicate winding means each comprise a set of at least two winding rollers, at least one of which is driven, and each of which is adapted to engage a loop of strip of magnetically permeable metal looped around it.

* * * * *